US005392563A

United States Patent [19]

Cardine

[11] Patent Number: 5,392,563

[45] Date of Patent: Feb. 28, 1995

[54] CLAMPING DEVICE FOR VEHICLE WINDER MECHANISM

[75] Inventor: Patrice Cardine, Orleans, France

[73] Assignee: Rockwell Automotive Body Systems, France

[21] Appl. No.: 48,335

[22] Filed: Apr. 15, 1993

[30] Foreign Application Priority Data

Apr. 22, 1992 [FR] France ..... 92 04926

[51] Int. Cl.[6] ..... E05F 11/48

[52] U.S. Cl. ..... 49/351; 49/375

[58] Field of Search ..... 49/351, 375

[56] References Cited

U.S. PATENT DOCUMENTS 4,120,120 10/1978 Becker ..... 49/351
4,991,351 2/1991 Bertonlini ..... 49/351
5,101,596 4/1992 Moore ..... 49/351

FOREIGN PATENT DOCUMENTS 0373301 6/1990 European Pat. Off. .

*Primary Examiner*—Philip C. Kannan

[57] ABSTRACT

This device comprises arms (1, 2) arranged in X configuration, a shaped rail (11) inside which there are mounted rollers (5, 6) to which are articulated the ends of the arms (1, 2), one (6) of the rollers being provided with means for blocking in the rail while the other roller (5) can slide in the latter; the means for blocking the said roller (6) comprise an elastic clamp (13) with two branches (14) shaped so as to be able to cap the opposite ends of the roller, and through-holes for these branches are made in the walls of the rail so that the said branches pass through the rail from one side to the other, clamping the roller between them. This clamp is easy to install and can be fitted to existing rollers, which avoids the use of special components and therefore decreases the manufacturing costs of the device.

3 Claims, 2 Drawing Sheets

CLAMPING DEVICE FOR VEHICLE WINDER MECHANISM

The subject of the present invention is a window support device in a vehicle window winder, as well as the window winder comprising this device.

French Patent 87 05 638 (2,614,355) describes a motor vehicle window winder of the type comprising arms arranged in X configuration one of which is driving and the other is driven. The upper ends of the two arms are associated with a window support device which comprises a horizontal shaped rail inside which there are mounted rollers to which are articulated the ends of the arms, one of the rollers being provided with means for translational blocking in the rail whilst the other roller can slide in the latter. The sliding roller is articulated to the driving arm, whilst the stationary roller is articulated to the driven arm.

The roller associated with the driven arm is fastened to the rail or slide in order to be able to cover a trajectory parallel to that of the window during the manoeuvres of actuating the window winder, this blocking system being called a "guiding point" blocking system.

In order securely to fasten the roller and the rail, use is generally made of specific components which do not always have the desired degrees of freedom, corresponding to an articulation on a joint. A device is thus known in which the component housed in the rail is pierced with an eyelet in which there is engaged a blocking screw passing through a corresponding tapped hole in the slide.

Another drawback of these known devices consists in the fact that they require a rail whose width is greater than that required for the displacement of the sliding roller in order to allow screwing, which is, in addition, a relatively long operation. The need for using specially shaped components in order to fasten them to the shaped rail, instead of the existing standard rollers, thus leads to a not inconsiderable cost increase.

The object of the invention is to provide a window support device by virtue of which these drawbacks are avoided.

In accordance with the invention, the window support device is characterised in that the means for blocking the roller comprise an elastic clamp with two branches shaped so as to be able to cap the opposite ends of the roller, and through-holes for these branches are made in the walls of the rail so that the said branches pass through the rail from one side to the other, clamping the roller between them.

This elastic clamp forming a clip is easy to install in order translationally to block the existing roller, which constitutes a standard component which may therefore be used without difficulty.

The invention will now be described with reference to the appended drawings which illustrate an embodiment thereof by way of a non-limiting example.

Figure 1:
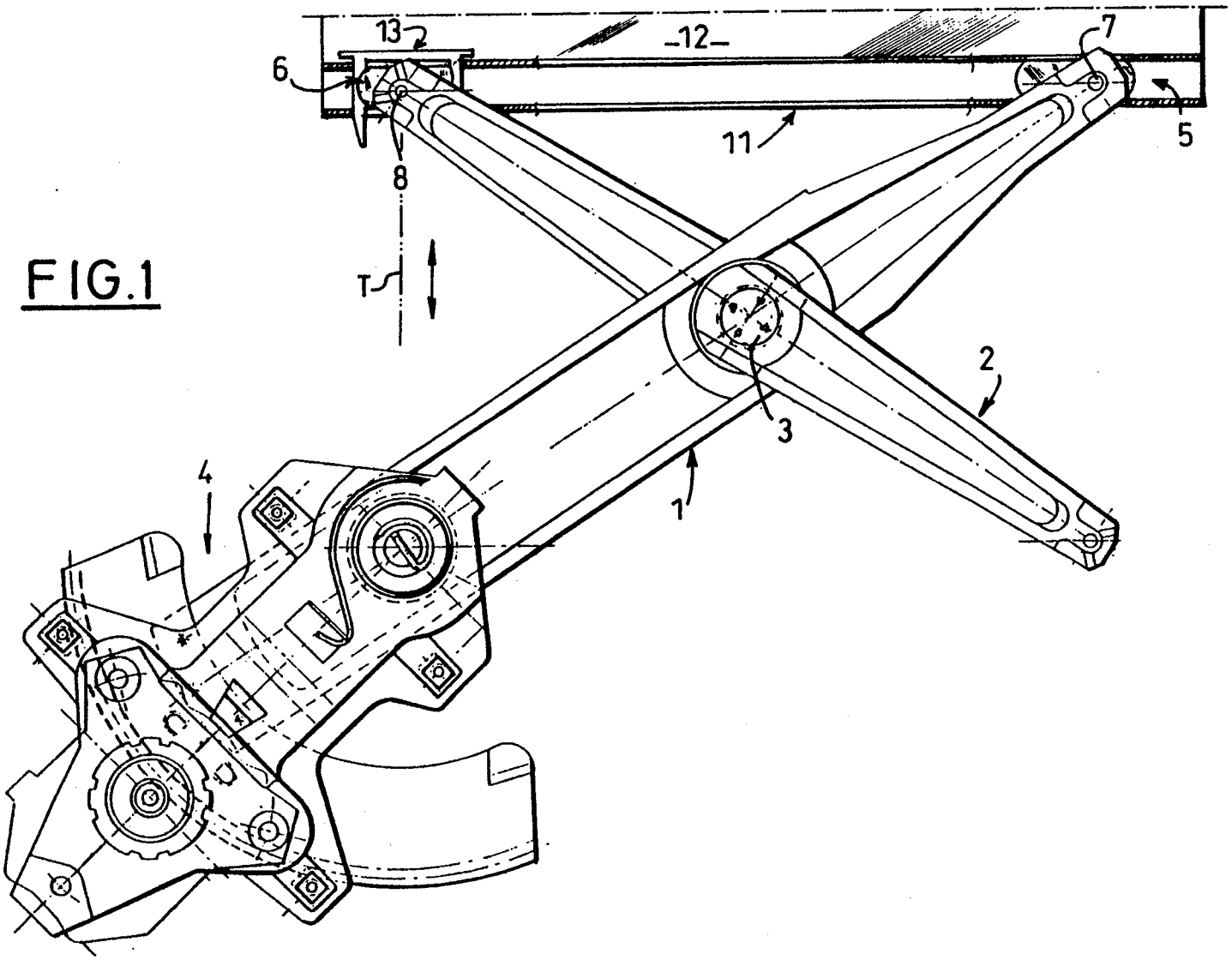
FIG. 1 is an elevation of a motor vehicle window winder of the type envisaged by the invention.
Figure 2:
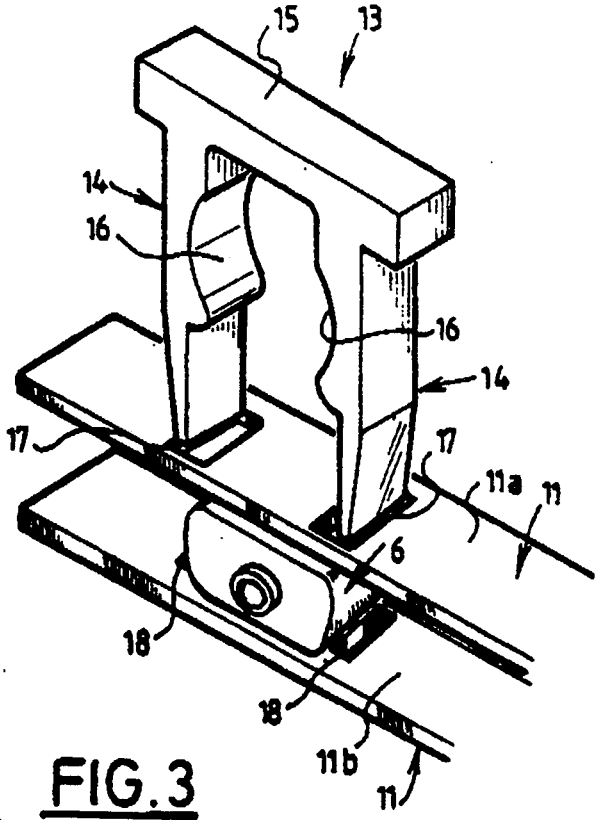
FIG. 2 is a partial perspective view on a larger scale with respect to FIG. 1 of an elastic clamp and of the shaped rail associated with the latter, according to an embodiment of the invention.
Figure 3:
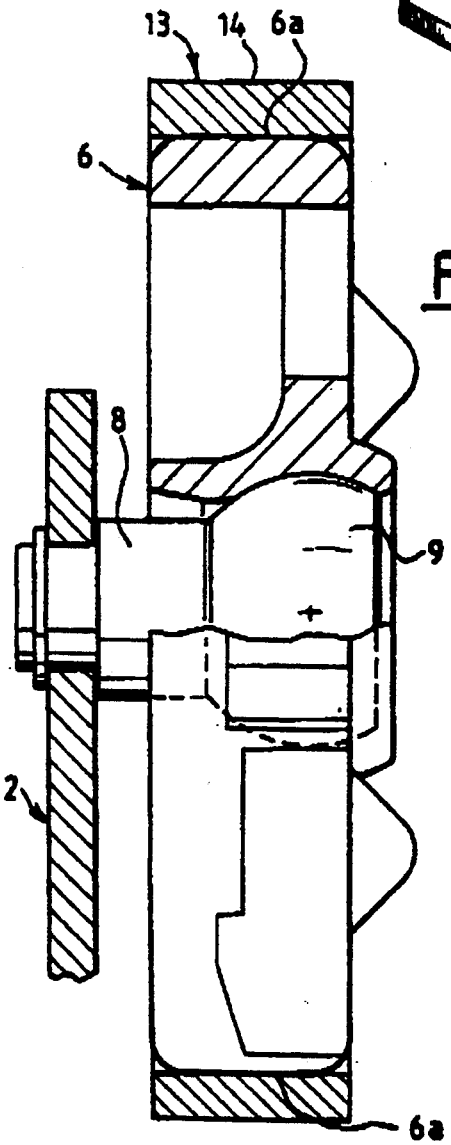
FIG. 3 is a horizontal sectional view on a larger scale of an embodiment of a sliding movable member and of its corresponding blocking clamp in the window support rail.

The device represented in FIG. 1 is a window winder mechanism comprising two arms 1, 2 arranged in X configuration and articulated about a common pin 3, as well as a device 4 for rotationally actuating the arm 1, this arm therefore being driving whilst the arm 2 is driven.

Such a window winder, well known per se, is described, for example, in French Patent 87 05 628 (2,614,355) and therefore does not require a detailed description.

The upper ends of the arms 1 and 2 are rotationally articulated on respective rollers or slides 5, 6 about pins 7, 8 carrying ball joints, only the ball joint 9 of the pin 8 of the arm 2 being visible in the drawing. The pins 7, 8 and their ball joints are mechanically securely fastened to the ends of the arms 1 and 2 and may therefore revolve with respect to the rollers 5, 6 during the angular displacements of the arms i and 2.

The rollers 5, 6 are similar and mounted inside a shaped rail 11 forming a slide, which supports, in a manner known per se, the window 12. The window winder and window 12 assembly is housed in a door, not shown.

The roller 6 associated with the upper half-arm of the driven arm 2 is translationally blocked in the rail 11, in order to cover a vertical trajectory T parallel to that of the window during the manoeuvres of the window winder, thereby constituting what is conventionally called a "guiding point". To this end, the roller 6 is blocked in the rail 11 by means of an elastic clamp 13 or clip, comprising two parallel branches 14 connected by a base 15. The opposing faces of the branches 14 each have a cutout 16 whose concavity is conjugate with the convexity of the ends 6a of the roller 6 in order to be able to cap the latter. Through-holes for the branches 14 are made in the walls 11a and 11b of the rail 11. Two holes 17 are thus formed in the wall 11a and two holes 18 in the wall 11b, opposite the holes 17, so that the branches 14 may pass through the rail 11 from one side to the other, elastically clamping the roller 6 between them.

The holes 17 are wider than the holes 18 in order to allow the passage of the median parts of the branches 14, which are wider than their ends which alone penetrate into the openings 18.

The roller 6 is thus effectively translationally blocked in the rail 11 and may be installed very easily. The elasticity of the branches 14 advantageously makes it possible to limit clearances and noise. The clamp 13 further exhibits the advantage, compared with the blocking means used to date, of allowing the use of the existing roller 6 with its ball joint 9, without modification, consequently avoiding replacing it with a special component. This substantially decreases the manufacturing cost of the blocking device.

Figure 4:
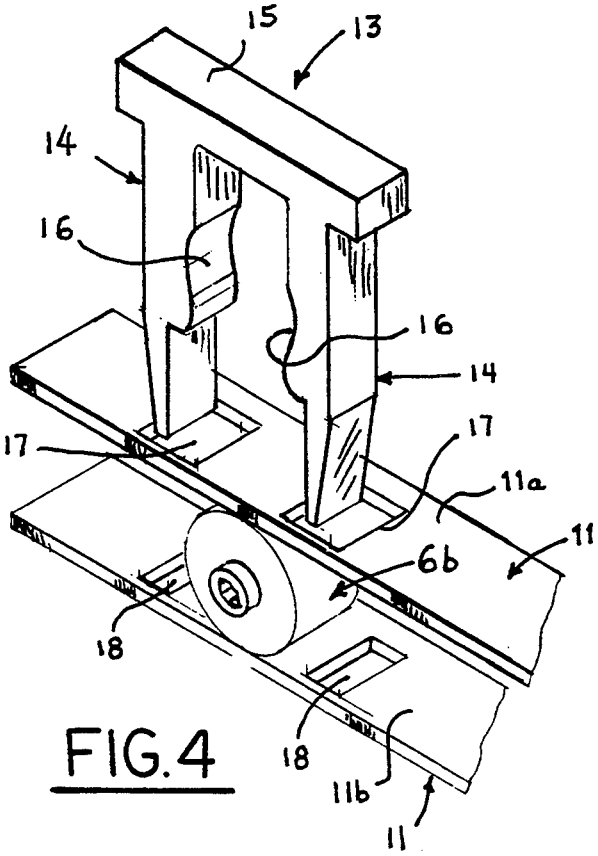
FIG. 4 is a horizontal section view on a larger scale of an embodiment of a roller movable member and of its corresponding blocking clamp in the window support rail.

FIG. 4 illustrates the use of the elastic clamp with a movable member of the roller type (*6b*).

I claim:

1. Window support device in a vehicle window winder of the type comprising arms arranged in X configuration, said device comprising a shaped rail having first and second walls extending parallel to one another and displaced by an integral portion of said rail inside which there are mounted movable members to which are articulated the ends of the arms, one of the movable members being provided with means for translational blocking in the rail while the other movable member can slide in the latter, characterized in that the means for blocking said movable member comprises an elastic clamp with two branches shaped so as to be able to cap the opposite ends of the movable member, and through-holes for these branches are defined in the walls of the rail so that said branches pass through the rail from one side to the other, elastically clamping the movable member between them by means of engagement between cutouts of said branches and rounded surfaces of the ends of the movable member.

2. The device of claim 1 wherein said movable member is a roller.

3. The device of claim 1 wherein said movable member is a slide.

* * * * *